United States Patent [19]

Nikaido et al.

[11] 4,105,511

[45] Aug. 8, 1978

[54] PROCESS FOR TREATING THE SURFACE OF ALUMINUM OR ALUMINUM ALLOY

[75] Inventors: Norio Nikaido; Shinji Shirai; Mototaka Iihashi; Sueo Umemoto; Kisaku Suzuki, all of Hiratsuka, Japan

[73] Assignee: Kansai Paint Company, Limited, Amagasaki, Japan

[21] Appl. No.: 806,061

[22] Filed: Jun. 13, 1977

Related U.S. Application Data

[63] Continuation-in-part of Ser. No. 646,760, Jun. 6, 1976, abandoned, which is a continuation of Ser. No. 482,663, Jun. 24, 1974, abandoned.

[30] Foreign Application Priority Data

Jul. 4, 1973 [GB] United Kingdom ..... 75989/73

[51] Int. Cl.[2] ..... C25D 11/06

[52] U.S. Cl. ..... 204/38 A; 204/58

[58] Field of Search ..... 204/35 N, 38 A, 58

[56] References Cited

U.S. PATENT DOCUMENTS

| | | | |
|---|---|---|---|
| 1,068,410 | 7/1913 | Chubb | 204/58 |
| 1,850,298 | 3/1932 | Washington, Jr. | 204/58 |
| 2,116,449 | 5/1938 | Robinson | 204/58 X |
| 2,859,148 | 11/1958 | Altenpohl | 148/6.27 |
| 2,868,702 | 1/1959 | Brennan | 204/28 |
| 2,981,647 | 4/1961 | Schwartz | 148/6.14 |
| 3,834,999 | 9/1974 | Hardcousky et al. | 204/56 R |
| 3,836,437 | 9/1974 | Osada et al. | 204/58 X |

*Primary Examiner*—John H. Mack
*Assistant Examiner*—William T. Leader
*Attorney, Agent, or Firm*—Larson, Taylor and Hinds

[57] ABSTRACT

A process for treating the surface of aluminum or aluminum alloy comprising the steps of contacting aluminum or aluminum alloy with hot water or steam to form an aluminum oxide layer thereon and conducting electrolysis using the resulting aluminum or aluminum alloy as an anode by applying direct current in an aqueous solution consisting essentially of a water-soluble salt of at least one oxyacid selected from the group consisting of silicic acid, phosphoric acid, molybdic acid, vanadic acid, permanganic acid, stannic acid and tungstic acid.

11 Claims, No Drawings

PROCESS FOR TREATING THE SURFACE OF ALUMINUM OR ALUMINUM ALLOY

This application is a continuation-in-part of our copending application Ser. No. 646,760 filed on June 6, 1976, (now abandoned) which is a continuation of our application Ser. No. 482,663 filed on June 24, 1974 (now abandoned).

This invention relates to a process for treating the surface of aluminum or aluminum alloy, more particularly to a process for treating the surface of aluminum or aluminum alloy having a boehmite layer formed thereon.

The surface of aluminum or aluminum alloy is chemically active and susceptible to corrosion by acids and alkalis. Accordingly, various methods have heretofore been proposed for reducing the activity of the surface of aluminum or aluminum alloy to improve the corrosion resistance thereof. One of such methods is known as so-called boehmite treatment by which aluminum or aluminum alloy is brought into contact with hot water or steam containing or not containing ammonia or amines so as to form on the surface of aluminum or aluminum alloy an aluminum oxide layer predominantly consisting of $Al_2O_3.nH_2O$ wherein $n$ is usually an integer of 1 to 3. Unlike other methods such as the anodic oxidation method wherein an acid such as sulphuric acid is used to form an aluminum oxide film, the boehmite treating method which does not employ acid is very advantageous for industrial operation since the use of acid causes corrosion in the apparatus during the anodic oxidation process, the resulting effluent involves pollution problems and removal of pollutant requires further treatment which needs high cost. Although the boehmite treating method is entirely free of these drawbacks, the thickness of aluminum oxide layer formed by this method on aluminum or aluminum alloy surface is limited up to about 1.0 $\mu$, and the aluminum oxide layer is not satisfactory in hardness and texture. Thus the boehmite treatment is inferior to other methods using acid in its ability to impart excellent corrosion resistance to aluminum or aluminum alloy.

An object of this invention is to eliminate the foregoing drawbacks of the conventional boehmite treating method.

Another object of this invention is to provide a process for treating the surface of aluminum or aluminum alloy which improves the corrosion resistance of aluminum or aluminum alloy having a boehmite layer formed thereon.

Other objects of this invention will become apparent from the following description.

The objects of this invention can be fulfilled by a process comprising the steps of contacting aluminum or aluminum alloy with hot water or steam containing or not containing ammonia or amines to form an aluminum oxide layer thereon and conducting electrolysis using the resulting aluminum or aluminum alloy as the electrode in an aqueous solution of a water-soluble salt of at least one oxyacid selected from the group consisting of silicic acid, phosphoric acid, molybdic acid, vanadic acid, permanganic acid, stannic acid and tungstic acid.

Our researches have revealed the following results:

(1) When aluminum or aluminum alloy is subjected to boehmite treatment, followed by electrolysis using the resulting aluminum or aluminum alloy as the electrode in an aqueous solution of water-soluble salt of at least one of the above-specified oxyacids, the oxyacid anions resulting from the dissociation of the oxyacid salt in the aqueous solution are adsorbed by the surface of the aluminum or aluminum alloy, whereupon they release their charges to react with the aluminum oxide layer, thereby forming a new layer.

(2) As compared with the aluminum oxide layer produced only by the boehmite treatment, the new layer obtained as above has a considerably larger thickness, improved toughness and fine texture and is therefore much more resistant to corrosion than the aluminum oxide layer alone.

(3) In the present invention in which only a water-soluble salt of the above-specified oxyacids is used, the salt hydrolyzes to produce a free base as well as an acid. Consequently, the solution containing the above-specified oxyacid salt but containing no free acid has a pH in the range of neutrality to alkalinity and acts effectively to form an inorganic composite boehmite-anodized film. The specified steps of this invention are essentially distinct from the process disclosed in U.S. Pat. No. 2,868,702 or U.S. Pat. No. 2,981,647 wherein aluminum or aluminum alloy is subjected to boehmite treatment and then subjected to anodic oxidation in an aqueous solution containing boric acid and borate, according to which process the addition of an acid makes the solution acidic and promotes the formation of alumite film by anodic oxidation.

According to the present invention, it is essential to conduct electrolysis using boehmite layer bearing aluminum or aluminum alloy as an anode by applying direct current in an aqueous solution of water-soluble salt of at least one oxyacid selected from the group consisting of silicic acid, phosphoric acid, permanganic acid, vanadic acid, tungstic acid, molybdic acid and stannic acid. The water-soluble oxyacid salts to be used include various salts of the above oxyacids with monovalent to trivalent metals, ammonia or organic amines. The silicates include orthosilicates, metasilicates and disilicates and like polysilicates. Examples thereof are sodium orthosilicate, potassium orthosilicate, lithium orthosilicate, sodium metasilicate, potassium metasilicate, lithium metasilicate, lithium pentasilicate, barium silicate, ammonium silicate, tetramethanol ammonium silicate, triethanol ammonium silicate, etc.

The phosphates include orthophosphates, pyrophosphates and polymetaphosphates. Examples are potassium monobasic phosphate ($KH_2PO_4$), sodium pyrophosphate ($Na_4P_2O_7$), sodium metaphosphate ($NaPO_3$), aluminum hydrophosphate [$Al(H_2PO_4)_3$], etc. The vanadates include orthovanadates, metavanadates and pyrovanadates. Examples are lithium orthovanadate ($Li_3VO_4$), sodium orthovanadate ($Na_3VO_4$), lithium metavanadate ($LiVO_3.2H_2O$), sodium metavanadate ($NaVO_3$), potassium metavanadate ($KVO_3$), ammonium metavanadate ($NH_4VO_3$) or [$(NH_4)_4V_4O_{12}$], sodium pyrovanadate ($Na_2V_2O_7$), etc. The tungstates include orthotungstates, metatungstates, paratungstates, pentatungstates and heptatungstates. Also employable are phosphorus wolframates, borotungstates and like complex salts. Examples are lithium tungstate ($Li_2WO_4$), sodium tungstate ($NaWO_4.2H_2O$), potassium tungstate ($K_2WO_4$), barium tungstate ($BaWO_4$), calcium tungstate ($CaWO_4$), strontium tungstate ($SrWO_4$), sodium metatungstate ($Na_2W_4O_{13}$), potassium metatungstate ($K_2W_4O_{13}.8H_2O$), sodium paratungstate ($Na_6W_7O_{24}$), ammonium pentatungstate [$(NH_4)_4W_5O_{17}.5H_2O$], ammonium heptatungstate [$(NH_4)_6W_7O_{24}.6H_2O$], sodium phosphowolframate ($2Na_2O.P_2O_5.12WO_3.18H_2O$), barium borotungstate ($2BaO.B_2O_3.9WO_3.18H_2O$), etc. Examples of permanganates are lithium permanganate ($LiMnO_4$), sodium permanganate ($NaMnO_4.3H_2O$), potassium permanganate ($KMnO_4$), ammonium permanganate [$(NH_4)MnO_4$], calcium permanganate [$Ca(MnO_4)_2.4H_2O$], barium permanganate [$Ba(MnO_4)_2$], magnesium permanganate [$Mg(MnO_4)_2.6H_2O$], strontium permanganate [$Sr(MnO_4)_2.3H_2O$], etc. The stannates include orthostannates and metastannates. Examples are potassium orthostannate ($K_2SnO_3.3H_2O$), lithium orthostannate ($Li_2SnO_3.3H_2O$), sodium orthostannate ($Na_2SnO_3.3H_2O$), magnesium stannate, calcium stannate, lead stannate, ammonium stannate, potassium metastannate ($K_2O.5SnO_2.4H_2O$), sodium metastannate ($Na_2O.5SnO_2.8H_2O$), etc. Examples of molybdates are orthomolybdates, metamolybdates and paramolybdates. More specific examples are lithium molybdate ($Li_2MoO_4$), sodium molybdate ($Na_2MoO_4$), potassium molybdate ($K_2MoO_4$), ammonium molybdate [$(NH_4)_6Mo_7O_{24}\ 4H_2O$], triethylamine molydate, etc.

Preferable among these oxyacid salts are those of alkali metals which generally have high water solubilities. Among the oxyacid salts enumerated above, silicates are preferable to use because they are economical and readily available. According to this invention these oxyacid salts are used singly or in admixture with one another.

The concentration of such oxyacid salt in its aqueous solution is usually about 0.1% by weight to saturation, preferably about 1.0% by weight to saturation, although variable with the kind of the oxyacid salt.

In the present invention, water-soluble salts of chromic acid can be used together with the abovementioned oxyacid salts, whereby the anti-corrosive property of the resulting coating is further improved. Such chromate is used in an amount of about 0 to 50 weight percent based on the oxyacid salt. Examples of the chromates are lithium chromate ($Li_2CrO_4.2H_2O$), sodium chromate ($Na_2CrO_4.10H_2O$), potassium chromate ($K_2CrO_4$), ammonium chromate [$(NH_4)_2CrO_4$], calcium chromate ($CaCrO_4.2H_2O$) and strontium chromate ($SrCrO_4$).

Alminum alloys to be coated by the process of this invention include, for example, Al-Si, Al-Mg, Al-Mn or Al-Si-Mg. In the present invention the aluminum and aluminum alloys can usually be used as substrates in various shaped forms.

To practice the present process, the aluminum or aluminum alloy serving as a substrate is subjected to degreasing and etching procedures. The degreasing is conducted by conventional methods, for examples, by immersing the aluminum or aluminum alloy in acid, such as nitric acid, sulfuric acid, at room temperature for 5 to 60 minutes. In the etching procedure, the defacement and spontaneously formed oxide film are removed from the aluminum or aluminum alloy by conventional methods, for example, by immersing the aluminum or aluminum alloy in alkali solution.

The aluminum or aluminum alloy thus pretreated is then subjected to boehmite treatment in conventional manner. The boehmite treatment is usually conducted by contacting the aluminum or aluminum alloy with hot water or steam containing or not containing ammonia or amines. Examples of the amines usable are monoethanolamine, diethanolamine, triethanolamine, dimethylethanolamine and like water-soluble amines. Generally, about 0.1 to 5 parts by weight of amine or ammonia are used per 100 parts by weight of water. The aluminum or aluminum alloy is kept in contact with hot water or steam usually for about 5 to 60 minutes under atomospheric pressure or elevated pressure. The temperature of hot water to be used is usually in the range of 60° C to boiling point, preferably boiling point and that of steam in the range of 100° to 200° C, preferably 120° to 180° C. Such contact is effected by methods heretofore employed, for example, by immersion or spraying.

After boehmite treatment, electrolysis is conducted as follows:

The aluminum or aluminum alloy and another electroconductive material used as anode and cathode respectively are immersed in aqueous solution of the above-specified oxyacid salt, and electric current is applied between the electrodes. The electric current may be either direct current or alternating current. When direct current is used, the aluminum or aluminum alloy is to be the anode and when alternating current is used, the aluminum or aluminum alloy can be used either as anode or as cathode. The advantageous range for the electric voltage is from 5 to 300 volts for direct current, or from 5 to 200 volts for alternating current. The electric current is applied for more than 5 seconds. The temperature of the electrolytic solution is usually in the range between the separating point of the salt of the oxyacid from the solution and the boiling point of the solution, preferably in the range of 20° to 60° C.

According to this invention, the electrolytic operation can be conducted repeatedly two or more times with an aqueous solution of the same oxyacid salt or with aqueous solutions of different oxyacid salts. For example, electrolysis is conducted with an aqueous solution of silicate and then with the same aqueous solution of silicate, or first with an aqueous solution of silicate and subsequently with an aqueous solution of another oxyacid salt. When repeatedly carried out, the electrolysis gives the resulting aluminum or aluminum alloy product higher corrosion resistance than when it is conducted only once. Moreover, the electrolysis causes some water to undergo electrolysis to give off hydrogen gas in the form of bubbles. Consequently, the bubbling lowers the efficiency of the electrolytic operation. However, if the electrolysis is conducted repeatedly, the evolution of hydrogen gas is noticeably reduced as compared with the case wherein the electrolytic operation is conducted only once, assuring improved efficiency.

After the electrolysis, the aluminum or aluminum alloy is rinsed with water and dried, whereby a thick coating of higher hardness and finer texture is formed. According to this invention, the dried product may further be heated at a temperature of about 150° to 250° C when desired to thereby increase the hardness of the coating.

The process of this invention will be described below in greater detail with reference to examples and comparison examples, in which the percentages and parts are all by weight unless otherwise specified. In the examples aluminum panels serving as substrates were prepared and electrolytic operation was conducted according to the procedures stated below.

Preparation of Substrate

A substrate was prepared by degreasing and etching an aluminum alloy panel measuring 70 mm in width, 150 mm in length and 2 mm in thickness (consisting of 98.0% aluminum, 0.45% Si, 0.55% Mg and 1% others; JIS H 4100) according to the procedure given below:

(a) Immersion in 10% aqueous solution of nitric acid at room temperature for 5 minutes.
(b) Rinsing in water.
(c) Immersion in 5% aqueous solution of caustic soda at 50° C for 5 minutes.
(d) Rinsing in water.
(e) Immersion in 10% aqueous solution of nitric acid at room temperature for 1 minute.
(f) Rinsing in water.

Electrolytic operation

Into a plastic container measuring 10 cm in width, 20 cm in length and 15 cm in depth was placed 2,000 cc of an solution of an oxyacid salt and the substrate serving as the anode and a mild steel plate serving as the cathode were immersed in the solution as spaced apart from each other by 15 cm. Electrolytic operation was conducted at a liquid temperature of 25° C by applying a specified voltage. The substrate was thereafter washed with water and dried.

In the examples and comparison examples to follow, acid resistance was determined by CASS test according to JIS H 8601. Alkali resistance was expressed in terms of time (in seconds) taken for bubbling to occur when 1 N aqueous solution of caustic soda was applied dropwise to the treated sample.

EXAMPLE 1

An aluminum substrate prepared as described above was immersed in boiling deionized water for 5 minutes for boehmite treatment, then rinsed with water and subsequently immersed in 20% aqueous solution of sodium silicate ($Na_2O.2SiO_2$) to conduct electrolysis at the specified voltage (d.c.) for the specified period of time as listed in Table 1 below. The aluminum substrate was then rinsed with water and dried at room temperature. The corrosion resistance of the aluminum substrate thus treated was measured with the result given in Table 1.

EXAMPLES 2 to 4

Aluminum substrates were treated in the same manner as in Example 1 except that electrolysis was conducted at the voltages and for periods of time listed in Table 1. The corrosion resistance of each of the aluminum substrates thus treated was measured with the result shown in Table 1.

COMPARISON EXAMPLE 1

An aluminum substrate prepared as above was immersed in boiling deionized water for 5 minutes for boehmite treatment, followed by rinsing with water and drying. The corrosion resistance of the treated substrate is listed in Table 1.

COMPARISON EXAMPLES 2 and 3

Aluminum substrates prepared as above were immersed in 20% aqueous solution of sodium silicate ($Na_2O.2SiO_2$) without conducting boehmite treatment, and electrolysis was carried out under the conditions listed in Table 1, followed by rinsing with water and drying. The corrosion resistance of each of the treated substrates was measured with the result given in Table 1.

EXAMPLES 5 and 6

After conducting electrolysis in the same manner as in Example 1 except that the conditions were otherwise specified as listed below, aluminum substrates were rinsed with water and then dried. Subsequently, the substrates were further heated to 200° C. The corrosion resistance of each of the substrates thus treated is shown in Table 1.

COMPARISON EXAMPLE 4

An aluminum substrate prepared as above was immersed in boiling deionized water for 5 minutes for boehmite treatment, followed by rinsing with water, drying and then heating at 200° C. The corrosion resistance of the treated substrate is listed in Table 1.

COMPARISON EXAMPLES 5 and 6

Aluminum substrates prepared as described above were immersed in 20% aqueous solution of sodium silicate ($Na_2O.2SiO_2$) to conduct electrolysis under the conditions listed in Table 1 below. The aluminum substrates were then rinsed with water, dried and then heated at 200° C for 1 hour. The corrosion resistance of each of the aluminum substrates thus treated was measured with the result given in Table 1.

Table 1

| | | Electrolysis conditions | | Acid resistance (Rating Number) | | Alkali resistance |
|---|---|---|---|---|---|---|
| | | Voltage (V) | Time (sec) | 4 (hours) | 8 (hours) | (sec) |
| Example | 1 | 40 | 120 | 9.5 | 9 | 95 |
| | 2 | 40 | 600 | 9.5 | 9 | 110 |
| | 3 | 80 | 120 | 9.5 | 9.5 | 132 |
| | 4 | 80 | 600 | 9.5 | 9.5 | 150 |
| Comparison Example | 1 | — | — | 8 | 6 | 12 |
| | 2 | 40 | 120 | 8 | 6 | 21 |
| | 3 | 80 | 600 | 8 | 6 | 25 |
| Example | 5 | 40 | 120 | 9.5 | 9 | 115 |
| | 6 | 80 | 120 | 9.8 | 9.5 | 160 |
| Comparison Example | 4 | — | — | 8 | 6 | 11 |
| | 5 | 40 | 120 | 8 | 6 | 20 |
| | 6 | 80 | 120 | 8 | 7 | 26 |

EXAMPLES 7 and 8

Aluminum substrates prepared as described above were immersed in a boiling solution consisting of 0.5 part of diethanol amine and 100 parts of deionized water for 15 minutes, then rinsed with water and subsequently immersed in 20% aqueous solution of potassium silicate ($K_2O.3SiO_2$) to conduct electrolysis under the conditions listed in Table 2 below. The aluminum substrates were then rinsed with water and dried at room temperature. The acid resistance of each of the aluminum substrates thus treated was measured with the result given in Table 2.

COMPARISON EXAMPLE 7

An aluminum substrate prepared as above was immersed in a boiling solution consisting of 0.5 part of diethanol amine and 100 parts of deionized water for 15 minutes, followed by rinsing with water and drying at room temperature. The acid resistance of the treated substrate is listed in Table 2.

Table 2

| | | Electrolysis conditions | | Acid resistance (Rating Number) | |
|---|---|---|---|---|---|
| | | Voltage (V) | Time (sec) | 4 (hours) | 8 (hours) |
| Example | 7 | 40 (d.c.) | 120 | 9.8 | 9.5 |
| | 8 | 80 (d.c.) | 120 | 10 | 9.5 |
| Comparison Example | 7 | — | — | 8.5 | 8 |

EXAMPLE 9 to 14

Aluminum substrates were treated in the same manner as in Example 1 except that oxyacid salts were used in the amount given in Table 3 in place of sodium silicate. The acid resistance of each of the substrates thus treated was determined with the result shown in Table 3.

Table 3

| Ex. No. | Kind of oxyacid salt | Concentration (%) | Electrolysis conditions Voltage (V) | Time (sec) | Acid resistance (Rating number) 4 (hours) | 8 (hours) |
|---|---|---|---|---|---|---|
| 9 | Sodium metaphosphate | 3.0 | 60 | 120 | 9.5 | 9.5 |
| 10 | Potassium permanganate | 2.0 | 60 | 120 | 9.5 | 9.5 |
| 11 | Ammonium metavanadate | 1.5 | 60 | 120 | 9.5 | 9.0 |
| 12 | Potassium tungstate | 3.0 | 60 | 120 | 9.5 | 9.0 |
| 13 | Potassium molybdate | 3.0 | 60 | 120 | 9.5 | 9.3 |
| 14 | Potassium orthostannate | 2.0 | 60 | 120 | 9.5 | 9.0 |

EXAMPLE 15

An aluminum substrate prepared as described previously was immersed in boiling deionized water for 10 minutes for boehmite treatment, then rinsed with water and subsequently immersed in a solution prepared by adding 10 parts of 55% aqueous solution of sodium silicate ($Na_2O.2SiO_2$) and 3 parts of potassium orthomolybdate ($K_2MoO_4$) to 100 parts of deionized water to conduct electrolysis by applying direct current at 50 volts for 60 seconds. The substrate was then taken out of the solution, rinsed with water and then dried at room temperature.

EXAMPLE 16

An aluminum substrate prepared as described previously was immersed in a boiling solution of 0.3 part of diethanolamine in 100 parts of deionized water for 10 minutes, then rinsed with water and subsequently immersed in an aqueous solution prepared by adding 10 parts of 55% aqueous solution of sodium silicate and 0.5 part of potassium metavanadate ($KVO_3$) to 150 parts of deionized water to conduct electrolysis by applying direct current at 30 volts for 3 minutes. The substrate was then taken out of the solution and rinsed with water. After drying, the substrate was heated at 180° C for 30 minutes.

EXAMPLE 17

An aluminum substrate subjected to boehmite treatment in the same manner as in Example 15 was immersed in a solution prepared by adding 15 parts of 40% aqueous solution of sodium silicate ($Na_2O.2SiO_2$) and 2 parts of potassium stannate ($K_2SnO_3.3H_2O$) to 150 parts of deionized water to conduct electrolysis by applying direct current at 30 volts for 30 minutes. The substrate was then taken out of the solution and rinsed with water. After drying, the substrate was heated at 180° C for 30 minutes.

The acid resistance of each of the treated aluminum substrates obtained in Examples 15 to 17 was measured with the result listed in Table 4 below.

Table 4

| | | Acid resistance (Rating Number) 4 (hours) | 8 (hours) |
|---|---|---|---|
| Example | 15 | 9.5 | 9 |
| | 16 | 9.5 | 9 |
| | 17 | 9.5 | 9 |

EXAMPLE 18

Aluminum substrates were treated in the same manner as in Example 15 except that oxyacid salts indicated in Table 5 were used in place of sodium silicate and potassium orthomolybdate. The acid resistance of the substrates thus treated was determined with the result shown in Table 5.

Table 5

| Ex. No. | Kind of oxyacid salts | Concentration (parts per 100 parts of water | Electrolysis condition Voltage(V) | Time(sec) | Acid resistance (Rating Number) 4(hours) | 8(hours) |
|---|---|---|---|---|---|---|
| 18 | Ammonium metavanadate | 1.5 | 60 | 120 | 9.5 | 9.3 |
| | Ammonium tungstate | 1.5 | | | | |

EXAMPLE 19

An aluminum substrate prepared as described previously was immersed in boiling deionized water for 10 minutes, then rinsed with water and subsequently immersed in 5% aqueous solution of sodium silicate ($Na_2O.2SiO_2$) to conduct electrolysis at 30 volts for 60 seconds. After rinsing with water, the substrate was immersed in 3% aqueous solution of ammonium paramolybdate [$(NH_4)_6Mo_7O_{24}$] to conduct electrolysis at 60 volts for 60 seconds. The substrate was then rinsed with water, thereafter dried and heated at 160° C for 30 minutes. Currents applied for electrolysis were direct current.

EXAMPLES 20 and 21

Aluminum substrates were treated in the same manner as in Example 19 except that oxyacid salts indicated in Table 6 were used in place of sodium silicate and ammonium paramolybdate. The corrosion resistance of each of the substrates thus treated in Examples 19 to 21 was determined with the result shown in Table 6.

Table 6

| Ex. No. | Kind of oxyacid acid salt: 1st Electrolysis | Kind of oxyacid acid salt: 2nd Electrolysis | Acid resistance (Rating Number) 4 (hours) | Acid resistance (Rating Number) 8 (hours) | Alkali resistance (sec) |
|---|---|---|---|---|---|
| 19 | Sodium silicate ($Na_2O \cdot 2SiO_2$) | Ammonium paramolybdate [$(NH_4)_6Mo_7O_{24}$] | 9.8 | 9.5 | 120 |
| 20 | Calcium permanganate [$Ca(MnO_4)_2 \cdot 4H_2O$] | Potassium stannate ($K_2SnO_3$) | 10 | 9.8 | 360 |
| 21 | Aluminum hydrophosphate [$Al(H_2PO_4)_3$] | Potassium metatungstate ($K_2W_4O_{13}$) | 9.5 | 9.5 | 360 |

EXAMPLE 22

An aluminum substrate prepared as described previously was immersed in boiling deionized water for 5 minutes for boehmite treatment, then rinsed with water and subsequently immersed in 3 wt.% aqueous solution of sodium metaphosphate to conduct electrolysis by applying direct current at 80 volts for 120 seconds.

COMPARISON EXAMPLE 8

An aluminum substrate prepared as described previously was immersed in boiling deionized water for 5 minutes for boehmite treatment, then rinsed with water and subsequently immersed in an aqueous solution containing 6 wt.% of phosphoric acid and 1.0 wt.% of sodium metaphosphate to conduct electrolysis by applying direct current at 80 volts for 120 seconds.

COMPARISON EXAMPLE 9

An aluminum substrate was treated in the same manner as in Comparison Example 8 except that 3 wt.% of sodium metaphosphate was used in place of 1.0 wt.% of sodium metaphosphate.

The corrosion resistance of each of the substrates thus treated in Example 22 and Comparison Examples 8 and 9 was determined with the result shown in Table 7.

Table 7

| | | Acid resistance (Rating No.) 4 hours | Acid resistance (Rating No.) 8 hours | Alkali resistance (sec) |
|---|---|---|---|---|
| Example | 22 | 9.5 | 9.5 | 121 |
| Comparison Example | 8 | 9.0 | 7.5 | 40 |
| | 9 | 9.0 | 7.5 | 50 |

What we claim is:

1. A process for treating the surface of aluminum or aluminum alloy comprising the steps of:

(i) contacting aluminum or aluminum alloy with hot water or steam to form an aluminum oxide layer thereon, and (ii) conducting electrolysis using the resulting aluminum or aluminum alloy as an anode by applying direct current in an aqueous solution containing no free acid consisting essentially of a water-soluble salt of at least one oxyacid selected from the group of silicic acid, phosphoric acid, molybdic acid, vanadic acid, permanganic acid, stannic acid, and tungstic acid.

2. The process for treating the surface of aluminum or aluminum alloy according to calim 1 in which the concentration of said water-soluble salt in the aqueous solution is in the range of 0.1 wt.% to saturation.

3. The process for treating the surface of aluminum or aluminum alloy according to claim 2 in which said concentration is in the range of 1.0 wt.% to saturation.

4. The process for treating the surface of aluminum or aluminum alloy according to claim 1 in which said water-soluble salt is at least one water-soluble salt of silicic acid.

5. The process for treating the surface of aluminum or aluminum alloy according to claim 1 in which said water-soluble salt is at least one water-soluble salt of phosphoric acid.

6. The process for treating the surface of aluminum or aluminum alloy according to claim 1 in which said water-soluble salt is at least one water-soluble salt of molybdic acid.

7. The process for treating the surface of aluminum or aluminum alloy according to claim 1 in which said water-soluble salt is at least one water-soluble salt of vanadic acid.

8. The process for treating the surface of aluminum or aluminum alloy according to claim 1 in which said water-soluble salt is at least one water-soluble salt of permanganic acid.

9. The process for treating the surface of aluminum or aluminum alloy according to claim 1 in which said water-soluble salt is at least one water-soluble salt of stannic acid.

10. The process for treating the surface of aluminum or aluminum alloy according to claim 1 in which said water-soluble salt is at least one water-soluble salt of tungstic acid.

11. An aluminum or aluminum alloy treated by the process claimed in claim 1.

* * * * *